US007964092B2

(12) United States Patent
Iqbal

(10) Patent No.: US 7,964,092 B2
(45) Date of Patent: Jun. 21, 2011

(54) HEAVY HYDROCARBON DEWATERING AND UPGRADING PROCESS

(75) Inventor: Rashid Iqbal, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 425 days.

(21) Appl. No.: 12/128,392

(22) Filed: May 28, 2008

(65) Prior Publication Data

US 2009/0294330 A1 Dec. 3, 2009

(51) Int. Cl.
*C10G 33/00* (2006.01)

(52) U.S. Cl. ..... 208/187; 208/85

(58) Field of Classification Search ..... 208/187; 48/71

See application file for complete search history.

(56) References Cited

U.S. PATENT DOCUMENTS

| | | | | |
|---|---|---|---|---|
| 4,137,053 | A * | 1/1979 | Mitchell et al. | 48/202 |
| 4,617,993 | A | 10/1986 | Brown | |
| 5,447,702 | A | 9/1995 | Campbell et al. | |
| 5,578,093 | A | 11/1996 | Campbell et al. | |
| 6,171,473 | B1 | 1/2001 | Fornoff | |
| 6,241,874 | B1 * | 6/2001 | Wallace et al. | 208/45 |
| 6,257,334 | B1 | 7/2001 | Cyr et al. | |
| 6,773,630 | B2 | 8/2004 | Stellaccio et al. | |
| 6,787,027 | B1 * | 9/2004 | Van Den Berg et al. | 208/187 |
| 6,896,707 | B2 | 5/2005 | O'Rear et al. | |
| 6,974,842 | B1 | 12/2005 | Spena et al. | |
| 2007/0045155 | A1 * | 3/2007 | Selmen et al. | 208/49 |

FOREIGN PATENT DOCUMENTS

EP 0634470 A1 1/1995

* cited by examiner

*Primary Examiner* — Glenn A Caldarola
*Assistant Examiner* — Michelle L Stein

(57) ABSTRACT

Systems and methods for processing hydrocarbons are provided. A first mixture including one or more hydrocarbons and water can be separated to provide a first waste water and a second mixture. The second mixture can be apportioned into a first portion and a second portion. The first portion can be separated to provide a second waste water and a third mixture. At least a portion of the third mixture and hydrocarbon containing solids can be combusted to provide a combustion gas. A portion of the hydrocarbon containing solids can be gasified to provide regenerated solids and gasified hydrocarbons. A portion of the second portion can be vaporized and cracked in the presence of the combustion gas and gasified hydrocarbons to provide vaporized hydrocarbons and cracked hydrocarbons. Hydrocarbons can be deposited onto the regenerated solids to provide the hydrocarbon containing solids. At least a portion of the combustion gas, gasified hydrocarbons, vaporized hydrocarbons, and cracked hydrocarbons can be selectively separated from the hydrocarbon containing solids to provide a hot gas product.

23 Claims, 3 Drawing Sheets

HEAVY HYDROCARBON DEWATERING AND UPGRADING PROCESS

BACKGROUND

1. Field

The present embodiments generally relate to systems and methods for dewatering and upgrading one or more hydrocarbons. More particularly, embodiments of the present invention relate to systems and methods for dewatering, cracking, and gasifying one or more hydrocarbons.

2. Description of the Related Art

The extraction of crude hydrocarbons from subterranean formations is often enhanced using various displacement technologies such as carbon dioxide stimulated recovery as disclosed in U.S. Pat. No. 4,617,993, and steam assisted gravity drainage (SAGD) as disclosed in U.S. Pat. No. 6,257,334. The introduction of one or more displacement fluids such as steam or carbon dioxide into subterranean formations can stimulate the flow of hydrocarbons for recovery and thus can improve productivity of marginal wells. However, hydrocarbons extracted using steam or other aqueous displacement fluids can typically contain a significant quantity of water which must be removed prior to subsequent processing of the extracted hydrocarbons.

Water can be removed from the extracted hydrocarbons using evaporation, gravity separation, chemical additives, electrostatic desalters, or combinations thereof. Evaporation of the water can be accomplished by heating the extracted hydrocarbons to a temperature greater than 100° C., whereupon any water present in the hydrocarbons will evolve as steam. Any dissolved salts or minerals present in the water prior to evaporation will remain trapped within the hydrocarbon after the water is evaporated. The presence of these residual salts and minerals can adversely impact subsequent downstream processing of the hydrocarbons.

Gravity settling is generally limited to applications where the hydrocarbon and water are not emulsified and where a sufficient difference in specific gravity exists between the hydrocarbon and water phases. When the water is partially or completely emulsified within the hydrocarbons, one or more dispersants, flocculants, or other settling aids can be used to break the emulsion and separate the hydrocarbon and water phases. When the hydrocarbon phase has a specific gravity similar to water, the addition of a low specific gravity diluent to the hydrocarbon phase can sufficiently lower the specific gravity of the hydrocarbon to permit separation by gravity settling. The transportation, storage, and recovery of a diluent can render the use of a diluent economically unattractive in remote processing locations.

Thus, a need exists for improved systems and methods for removing water from extracted hydrocarbons and upgrading the dewatered hydrocarbons.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
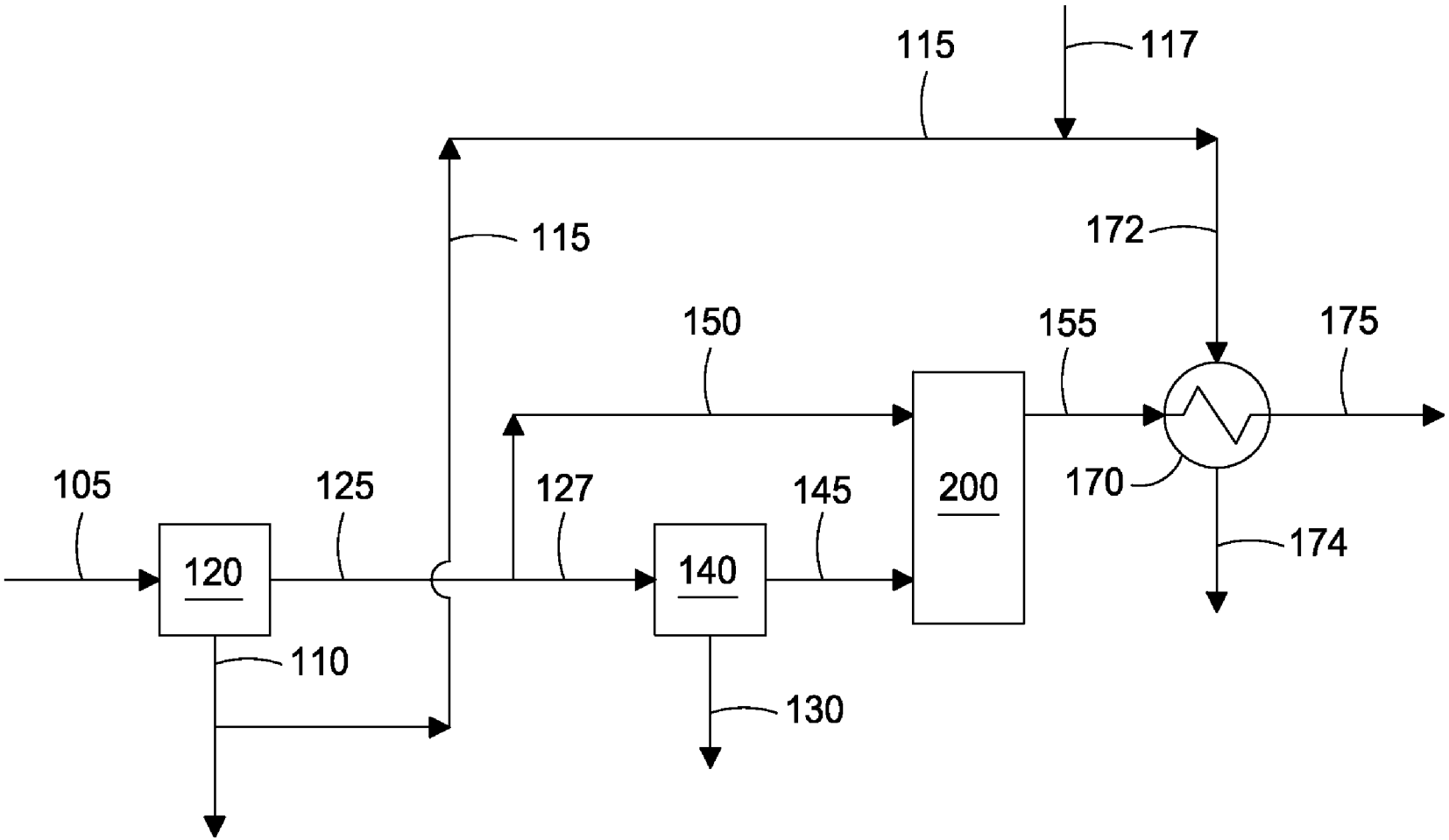
FIG. 1 depicts an illustrative treatment system for processing a hydrocarbon and water mixture, according to one or more embodiments described.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for processing hydrocarbons are provided. In one or more embodiments, water from a first mixture, which can include one or more hydrocarbons and water, can be selectively separated to provide a first waste water and a second mixture. The second mixture can include one or more hydrocarbons and water. The water concentration of the second mixture can range from about 2.5% wt to about 75% wt. In one or more embodiments, the second mixture can be apportioned into a first portion and a second portion. In one or more embodiments, the first portion can be selectively separated to provide a second waste water and a third mixture. The third mixture can include one or more hydrocarbons and water. The water concentration of the third mixture can range from about 1% wt to about 40% wt. In one or more embodiments, at least a portion of the third mixture and hydrocarbon containing solids can be combusted in the presence of an oxidant to provide a combustion gas. The combustion gas can include, but is not limited to carbon monoxide, carbon dioxide, and water. The combustion gas can be at a temperature of from about 400° C. to about 1,650° C. In one or more embodiments, a portion of the hydrocarbon containing solids can be gasified to provide regenerated solids and gasified hydrocarbons comprising hydrogen, carbon monoxide, and carbon dioxide. In one or more embodiments, a portion of the second portion can be vaporized in the presence of the combustion gas and gasified hydrocarbons to provide vaporized hydrocarbons. In one or more embodiments, a portion of the second portion can be cracked in the presence of the combustion gas and gasified hydrocarbons at a temperature sufficient to provide cracked hydrocarbons. The cracked hydrocarbons can include more than 0.5% vol $C_1$-$C_3$ hydrocarbons, more than 0.5% vol $C_4$-$C_6$ hydrocarbons, and more than 1% vol $C_7$-$C_9$ hydrocarbons. In one or more embodiments, liquid hydrocarbons, solid hydrocarbons, or both can be deposited onto the regenerated solids to provide the hydrocarbon containing solids. In one or more embodiments, at least a portion of the combustion gas, gasified hydrocarbons, vaporized hydrocarbons, and cracked hydrocarbons can be selectively separated from the hydrocarbon containing solids to provide a hot gas product.

The first mixture can contain one or more hydrocarbons including, but not limited to one or more crude oils, oil shales, oil sands, tars, bitumens, naphthas, distillates, gas oils, derivatives thereof, and mixtures thereof. At least a portion of the first mixture can contain one or more hydrocarbons extracted using carbon dioxide, hydrocarbon gases, steam or other gaseous or aqueous displacement fluids. In one or more embodiments, the first mixture can include from about 10% wt to about 90% wt water or other aqueous fluids.

The second mixture can be apportioned into a first portion and a second portion. The first portion can contain from about 5% wt to about 95% wt of the second mixture. The second portion can contain from about 5% wt to about 95% wt of the second mixture. At least a portion of the water can be removed from the first portion of the second mixture to provide a third mixture containing one or more separated hydrocarbons having a water concentration of from about 1.5% wt to about 50% wt. The water removed from the first mixture and the first portion of the second mixture can be combined to provide a waste water. All or a portion of the third mixture can be combusted to provide a hot combustion gas or ("hot gas").

In one or more embodiments, at least a portion of the one or more hydrocarbons in the second portion of the second mixture can be vaporized using the hot gas generated by combusting at least a portion of the third mixture. For example, at least a portion of the one or more crude oils, oil shales, oil sands, tars, bitumens, naphthas, distillates, gas oils, derivatives thereof, and mixtures thereof can vaporize. In one or more embodiments, at least a portion of the one or more crude oils, oil shales, oil sands, tars, bitumens, naphthas, distillates, gas oils, derivatives thereof, and mixtures thereof in the second portion can thermally crack upon exposure to the hot exhaust gas to provide cracked hydrocarbons. The hot gas can have a temperature of about 400° C. or more. In one or more embodiments, at least a portion of the heavier hydrocarbons, for example the crude oils, oil shales, oil sands, tars, and bitumens that can be present in the second portion can be deposited as a layer of coke onto the surface of solids, providing hydrocarbon containing solids which can be suspended in the hot gas.

In one or more embodiments, the hot gas can include, but is not limited to hydrogen, carbon monoxide, carbon dioxide, the vaporized hydrocarbons, the cracked hydrocarbons, and the coke-covered solids. In one or more embodiments, the hydrocarbon containing solids can be selectively separated from the hot gas to provide a solids-lean hot gas containing hydrogen, carbon monoxide, carbon dioxide, vaporized hydrocarbons, and the cracked hydrocarbons. In one or more embodiments, at least a portion of the separated, hydrocarbon containing solids can be combusted to provide at least a portion of the hot gas. In one or more embodiments, at least a portion of the waste water can be directly or indirectly heated using the hot gas to provide steam. For example, at least a portion of the waste water can be directly or indirectly heated by the hot gas to provide high pressure steam. The waste water can optionally be treated or otherwise purified to provide a treated waste water that can be used to in other processes, heated against the hot gas to provide steam, or disposed. In one or more embodiments, the untreated and/or treated waste water can be indirectly heated using the hot gas to provide steam that can be used to extract additional hydrocarbons, for example using SAGD.

In one or more embodiments, the first waste water and/or the second waste water can be indirectly heated using the hot gas to provide steam and a cooled gas product. In one or more embodiments, the steam can be high pressure, medium pressure, and/or low pressure steam. The steam can be used for various process, which can include, but are not limited to SAGD processes and power production via one or more steam turbine and generator systems.

FIG. 1 depicts an illustrative treatment system for processing a mixture containing one or more hydrocarbons and water ("first mixture"), according to one or more embodiments. The treatment system can include one or more separators (two are shown 120 and 140), one or more gasifier systems 200, and one or more heat exchange zones or heat exchangers (one is shown 170). The first mixture can be introduced via line 105 to the one or more separators 120 to remove at least a portion of the water to provide a waste water ("first waste water") via line 110, and a hydrocarbon and water mixture ("second mixture") via line 125. Although not shown, one or more diluents, dispersants, flocculants, or other settling and/or separation aids can be mixed or otherwise combined with the first mixture in line 105 or in the separator 120 to assist in separating water from the first mixture. In one or more embodiments, the first mixture in line 105 can be heated to a temperature of from 40° C. to about 100° C. to promote the separation of water from the first mixture in the separator 120.

The first mixture in line 105, can include, but is not limited to, one or more crude oils, oil shales, oil sands, tars, bitumens, naphthas, distillates, gas oils, derivatives thereof, and mixtures thereof. The first mixture can include water. In one or more embodiments, the first mixture in line 105 can contain one or more hydrocarbons mixed with water or other aqueous extraction fluids, for example steam condensate from SAGD. The first mixture in line 105 can also include one or more refined or partially refined hydrocarbons containing water in any volume and/or concentration, examples of which can include wellhead crude oils, waste oils, lubricating oils, atmospheric tower bottoms, vacuum tower bottoms, deasphalted oils, asphaltenes, naphthas, light hydrocarbons, distillates, bitumens, mixtures thereof, derivatives thereof, or any combination thereof. The water concentration in the first mixture in line 105 can range from about 10% wt to about 90% wt, from about 20% wt to about 85% wt, from about 40% wt to about 80% wt, or from about 30% wt to about 90% wt. The temperature of the first mixture in line 105 can range from about 1° C. to about 150° C., about 1° C. to about 125° C., about 1° C. to about 110° C., about 1° C. to about 100° C. Although not shown, the first mixture in line 105 can be heated to a suitable temperature to assist or promote the separation of the water from the hydrocarbons and/or to improve the flow properties of the first mixture. The pressure of the first mixture in line 105 can range from about 101 kPa to about 2,850 kPa, about 200 kPa to about 2,500 kPa, about 300 kPa to about 2,000 kPa, or about 300 kPa to about 1,500 kPa.

As used herein, the terms "bitumen" and "bitumens" are used interchangeably and refer to one or more hydrocarbons that can include, but are not limited to, mineral pitches rich in asphaltenes, mineral waxes, and other complex, high-molecular-weight hydrocarbons which may be present as a liquid and/or a solid. Bitumens can include lighter hydrocarbon compounds, for example LPG, naphtha, distillates, and gas oils. Bitumens can include one or more hydrocarbons having an API specific gravity of less than 10°.

In one or more embodiments, the hydrocarbon concentration in the second mixture in line 125 can range from about 10% wt to about 95% wt, from about 20% wt to about 85% wt, or from about 25% wt to about 65% wt. In one or more embodiments, the water concentration in the second mixture in line 125 can range from about 1% wt to about 90% wt, from about 2.5% wt to about 75% wt, from about 15% wt to about 80% wt, or from about 35% wt to about 75% wt. In one or more embodiments, the temperature of the second mixture in line 125 can range from about 1° C. to about 150° C., about 1° C. to about 125° C., about 1° C. to about 110° C., about 1° C. to about 100° C. Although not shown, the second mixture in line 125 can be heated to a suitable temperature to assist or promote the separation of the water from the hydrocarbons and/or to improve the flow properties of the second mixture. In one or more embodiments, the pressure of the second mixture in line 125 can range from about 101 kPa to about 2,850 kPa, about 200 kPa to about 2,500 kPa, about 300 kPa to about 2,000 kPa, or about 300 kPa to about 1,500 kPa.

In one or more embodiments, the water concentration in the first waste water in line 110 can be about 60% wt or more, about 75% wt or more, about 90% wt or more, about 95% wt or more, or about 99% wt or more. In one or more embodiments, the hydrocarbon concentration in the first waste water in line 110 can be about 30% wt or less, about 20% wt or less, about 10% wt or less, about 5% wt or less, or about 1% wt or less. In one or more embodiments, the temperature of the first waste water in line 110 can range from about 1° C. to about 100° C., about 1° C. to about 90° C., about 1° C. to about 80° C., or about 1° C. to about 70° C. In one or more embodiments, the pressure of the first waste water in line 110 can range from about 101 kPa to about 2,850 kPa, about 200 kPa to about 2,500 kPa, about 300 kPa to about 2,000 kPa, or about 300 kPa to about 1,500 kPa.

The one or more separators 120 can include any system, device, or combination of systems and/or devices suitable for separating the first mixture in line 105 into a hydrocarbon phase and a water phase. The one or more separators 120 can include one or more powered devices, one or more unpowered or passive devices, or any combination thereof. In one or more embodiments, an American Petroleum Institute (API) type gravity separator and/or settler can be used with or without surface skimmers and/or bottom drags. In one or more embodiments, the separator 120 can also include, but is not limited to, one or more parallel plate separators, rotating skimmers, horizontal sinusoidal parallel plate separators, dissolved air flotation units, dispersed air flotation units, hydrocyclones, centrifuges, or any combination of one or more types of devices in series or parallel. The operating temperature of the one or more separators 120 can range from about 1° C. to about 110° C., about 1° C. to about 105° C., or about 1° C. to about 100° C. The operating pressure of the one or more separators 120 can range from about 101 kPa to about 2,850 kPa, about 200 kPa to about 2,500 kPa, about 300 kPa to about 2,000 kPa, or about 300 kPa to about 1,500 kPa.

In one or more embodiments, the second mixture in line 125 can be equally or unequally apportioned to provide the first portion in line 127 and the second portion in line 150. In one or more embodiments, the first portion in line 127 can include about 5% wt to about 95% wt, about 5% wt to about 70% wt, about 5% wt to about 50% wt, or about 5% wt to about 40% wt of the second mixture in line 125. In one or more embodiments, the second portion in line 150 can include about 5% wt to about 95% wt, about 10% wt to about 95% wt, about 60% wt to about 95% wt, about 70% wt to about 95% wt, or about 80% wt to about 95% wt of the second mixture in line 125.

The first portion of the second mixture can be introduced via line 127 to the one or more separators 140 where at least a portion of the water can be removed from the second mixture to provide a waste water ("second waste water") via line 130 and the third mixture via line 145. Although not shown, one or more chemical separation aids, such as coagulants, coalescents, or flocculating agents, can be added to the first portion in line 127 to assist in separating water from the first portion in line 127. One or more mechanical or physical separation aids, such as ultrasonic stimulation, can be used to assist in separating the first portion in line 127 into a water phase and a hydrocarbon phase within the separator 140. In one or more embodiments, chemical, physical and/or mechanical separation aids can be used to assist in separating the first portion into a water phase and a hydrocarbon phase.

In one or more embodiments, the hydrocarbon concentration in the third mixture in line 145 can range from a low of about 40% wt, about 60% wt, or about 75% wt to a high of about 85% wt, about 90% wt, or about 95% wt. In one or more embodiments, the water concentration in the third mixture in line 145 can range from a low of about 1% wt, about 5% wt, about 10% wt, or about 15% wt to a high of about 20% wt, about 30% wt, or about 40% wt or about 50% wt. The temperature of the third mixture in line 145 can range from about 1° C. to about 150° C., about 1° C. to about 125° C., about 1° C. to about 110° C., or about 1° C. to about 100° C., Although not shown, the third mixture in line 145 can be heated to a suitable temperature to improve the flow properties of the second mixture and/or to preheat the third mixture prior to introducing the third mixture the gasifier 200. The pressure of the third mixture in line 145 can range from about 101 kPa to about 2,850 kPa, about 200 kPa to about 2,500 kPa, about 300 kPa to about 2,000 kPa, or about 300 kPa to about 1,500 kPa.

The second waste water in line 130 can include all or a portion of the water from the first portion in line 127 separated within the separator 140. The water concentration in the second waste water in line 130 can be about 80% wt or more, about 85% wt or more, about 90% wt or more, about 95% wt or more, or about 99% wt or more. The hydrocarbon concentration in the second waste water in line 130 can be about 10% wt or less, about 5% wt or less, about 1% wt or less. The temperature of the second waste water in line 130 can range from about 1° C. to about 100° C., about 1° C. to about 90° C., or about 1° C. to about 80° C. The pressure of the second waste water in line 140 can range from about 101 kPa to about 2,850 kPa, about 200 kPa to about 2,500 kPa, about 300 kPa to about 2,000 kPa, or about 300 kPa to about 1,500 kPa.

The one or more separators 140 can include any system, device or combination of systems and/or devices suitable for separating the first portion of the second mixture in line 125 into the third mixture and the second waste water. The separator 140 can be unpowered or powered. In one or more embodiments, an American Petroleum Institute (API) type gravity settler can be used with or without surface skimmers and/or bottom drags. In one or more embodiments, the separator 140 can also include, but are not limited to, one or more parallel plate separators, rotating skimmers, horizontal sinusoidal parallel plate separators, dissolved air flotation units, dispersed air flotation units, hydrocyclones, centrifuges, or any combination of one or more types of devices in series or parallel. The operating temperature of the one or more separators 140 can range from about 1° C. to about 110° C., about 1° C. to about 105° C., or about 1° C. to about 100° C. The operating pressure of the one or more separators 140 can range from about 101 kPa to about 2,850 kPa, about 200 kPa to about 2,500 kPa, about 300 kPa to about 2,000 kPa, or about 300 kPa to about 1,500 kPa.

All or a portion of the third mixture in line 145 can be introduced to the one or more gasifiers 200. In one or more embodiments, at least a portion of the third mixture via line 145 can be introduced to a combustion or oxidation zone within the one or more gasifiers 200. In one or more embodiments, all or a portion of the second portion in line 150 can be introduced to a gasification zone within the one or more gasifiers 200. The second portion via line 150 can be introduced in parallel with the third mixture introduced via line 145 to the oxidation zone of the one or more gasifiers 200. The third mixture in line 145 and the second portion in line 150 can be introduced simultaneously, sequentially, alternatively, or any combination thereof, to the gasifier 200 based upon operating conditions within the gasifier 200 and desired finished products.

In one or more embodiments, at least a portion of the hydrocarbons in the third mixture in line 145 can be combusted or otherwise oxidized in the combustion zone of the gasifier 200 to provide heat and the hot gas. In one or more embodiments, hydrocarbon containing solids can be combusted or otherwise oxidized in the combustion zone of the gasifier 200 to provide additional heat, hot gas, and regenerated solids. The hot gas can include, but is not limited to carbon monoxide, carbon dioxide, and hydrogen. The temperature of the hot gas can range from about 400° C. to about 1,650° C., from about 400° C. to about 1,370° C., or from about 400° C. to about 1,095° C.

In one or more embodiments, the introduction of at least a portion of the second portion in line 150 to the gasification zone of the gasifier 200 can result in the partial or complete vaporization and/or cracking of the hydrocarbons in the second portion by the hot gas. The vaporization and cracking can both occur within the gasification zone. In one or more embodiments, at least a portion of the hydrocarbons in the second portion in line 150, which can include, but are not limited to naphthas, distillates, and gas oils, can vaporize or flash upon exposure to the hot gas. In one or more embodiments, at least a portion of the hydrocarbons present in the second portion in line 150 can crack or convert to one or more lighter hydrocarbon products upon exposure to the hot gas. In one or more embodiments, at least a portion of the hydrocarbons present in the second portion in line 150 can deposit as a layer of carbonaceous coke on the regenerated solids present in the hot gas to provide the hydrocarbon containing solids. In one or more embodiments, the vaporizing, cracking, and depositing of the hydrocarbons present in the second portion introduced via line 150 to the gasification zone can all occur within the gasification zone. The hydrocarbons that can deposit on the solids can be liquid hydrocarbons, solid hydrocarbons, or both. The combined hot gas, vaporized hydrocarbons, cracked hydrocarbons, and hydrocarbon containing solids ("hot gas mixture") can be removed from the gasifier 200 via line 155 as a hot gas product. In one or more embodiments, the hydrocarbon containing solids can be selectively separated from the hot gas mixture in a separation zone to provide a solids-lean hot gas product via line 155.

In one or more embodiments, about 20% wt, 30% wt, 40% wt, 50% wt, 60% wt, 70% wt or more of the hydrocarbons, for example the bitumens in the second portion in line 150 can vaporize and/or crack. In one or more embodiments, the percent of the hydrocarbons in the second portion in line 150 that can vaporize and/or crack can range from about 10% wt to about 60% wt, from about 20% wt to about 50% wt, or from about 30% wt to about 40% wt. In one or more embodiments, about 20% wt to about 50% wt, from about 30% wt to about 60% wt, or from about 40% wt to about 60% wt of the hydrocarbons in the second portion can vaporize and/or crack. In one or more embodiments, at least a portion of the non-vaporized and un-cracked hydrocarbons in the second portion can deposit on the solids to provide the coke-covered solids.

The hot gas product in line 155 can include, but is not limited to, one or more naphthas, distillates, gas oils, $C_1$ to $C_{20}$ hydrocarbon compounds, carbon monoxide, carbon dioxide, hydrogen, water vapor, coke-covered solids, derivatives thereof, and mixtures thereof. In one or more embodiments, the hot gas product in line 155 and/or 175 can be selectively separated to provide one or more products, for example a naphtha product, a distillate product, a gas oil product, and a syngas product, which can include hydrogen, carbon monoxide, and carbon dioxide. In one or more embodiments, the naphtha concentration in the hot gas product in line 155 can range from about 1% vol to about 40% vol, about 2% vol to about 35% vol, about 3% vol to about 30% vol, about 4% vol to about 25% vol, or about 5% vol to about 20% vol. In one or more embodiments, the distillate concentration in the hot gas product in line 155 can range from about 1% vol to about 40% vol, about 2% vol to about 35% vol, about 3% vol to about 30% vol, about 4% vol to about 25% vol, or about 5% vol to about 20% vol. In one or more embodiments, the gas oil concentration in the hot gas product in line 155 can range from about 1% vol to about 40% vol, about 2% vol to about 35% vol, about 3% vol to about 30% vol, about 4% vol to about 25% vol, or about 5% vol to about 20% vol.

In one or more embodiments, the $C_1$-$C_3$ concentration in the hot gas product in line 155 can range from about a low of about 0.5% vol, about 1% vol, about 5% vol, or about 10% vol to a high of about 30% vol, about 50% vol, about 70% vol, or about 95% vol. In one or more embodiments, the $C_4$-$C_6$ concentration in the hot gas product in line 155 can range from a low of about 0.5% vol, about 1.5% vol, about 5% vol, or about 10% vol to a high of about 30% vol, about 50% vol, about 70% vol, or about 95% vol. In one or more embodiments, the $C_7$-$C_9$ concentration in the hot gas product in line 155 can range from a low of about 1% vol, about 2% vol, about 5% vol, or about 10% vol to a high of about 30% vol, about 50% vol, about 70% vol, or about 95% vol. In one or more embodiments, the $C_{10}$-$C_{12}$ concentration in the hot gas product in line 155 can range from about 1% vol to about 40% vol, about 2% vol to about 35% vol, about 3% vol to about 30% vol, about 4% vol to about 25% vol, or about 5% vol to about 20% vol.

In one or more embodiments, the carbon monoxide concentration in the hot gas product in line 155 can range from about 1% vol to about 50% vol, about 2% vol to about 45% vol, about 3% vol to about 40% vol, about 4% vol to about 35% vol, or about 5% vol to about 30% vol. In one or more embodiments, the carbon dioxide concentration in the hot gas product in line 155 can range from about 1% vol to about 50% vol, about 2% vol to about 45% vol, about 3% vol to about 40% vol, about 4% vol to about 35% vol, or about 5% vol to about 30% vol. In one or more embodiments, the water concentration in the hot gas product in line 155 can range from about 1% vol to about 50% vol, about 2% vol to about 45% vol, about 3% vol to about 40% vol, about 4% vol to about 35% vol, or about 5% vol to about 30% vol.

The temperature of the hot gas product in line 155 can range from about 400° C. to about 1,650° C., about 510° C. to about 1,500° C., or about 600° C. to about 1,200° C. The pressure of the hot gas product in line 155 can range from about 101 kPa to about 10,400 kPa, about 200 kPa to about 9,380 kPa, about 300 kPa to about 8,350 kPa, or about 400 kPa to about 6,975 kPa.

In one or more embodiments, the one or more gasifiers 200 can include any gasifier known in the art suitable for gasification of one or more hydrocarbon feedstocks. In addition to the oxidation zone and gasification zones previously discussed, in one or more embodiments, the gasifier 200 can include an intermediate reduction zone disposed between the oxidation and gasification zones. In one or more embodiments, the gasifier 200 can include one or more types of gasifiers, including, but not limited to, updraft, downdraft, counter-current, co-current, cross-draft, fluidized bed, double-fired, entrained bed and molten-bath type gasifiers. In one or more embodiments, the gasifier 200 can incorporate one or more efficiency improvement features, including, but not limited to, plug flow, rapid-mix multi-port feed injection, cooled walls, or any combination of technologies to enhance gasification efficiency. The operating temperature of the gasifier 200 can range from about 400° C. to about 1,650° C., about 510° C. to about 1,500° C., about 600° C. to about 1,200° C., or about 760° C. to about 1,650° C. The operating pressure of the In one or more embodiments, the one or more solids or transport mediums can be or can include, but are not limited to refractory oxides, such as alumina, alpha alumina, zirconia, titania, hafnia, silica, or mixtures thereof, rare earth modified refractory metal oxides, where the rare earth may be any rare earth metal (e.g. lanthanum or yttrium); alkali earth metal modified refractory oxides; ash; derivatives thereof, or mixtures thereof. The transport media can be categorized as materials having a substantially stable surface area at reaction conditions, for example, a surface area that is not substantially altered by reaction conditions, or altered in a way that affects the gasification process.

In one or more embodiments, the hot gas product, exiting the gasifier via line 155, can be cooled using one or more heat exchangers 170. In one or more embodiments, the one or more heat exchangers 170 can indirectly transfer heat from the hot gas product to a heat transfer medium to provide a cooled gas product via line 175. In one or more embodiments, the heat transfer medium can include process water, boiler feed water, or any other suitable aqueous based solution. In one or more embodiments, the heat transfer medium can include at least a portion of the first waste water in line 110, which can be introduced to the one or more heat exchangers 170 via line 115. In one or more embodiments, supplemental or make-up water introduced via line 117 can be added to the first waste water in line 115, which can be introduced to the one or more heat exchangers 170 via line 172. In one or more embodiments, the heat transfer medium can include at least a portion of the second waste water in line 130, not shown. In one or more embodiments, at least a portion of the first waste water in line 110 and/or the second waste water in line 130 can be introduced to the gasifier 200 and/or to the hot gas product in line 155 to directly quench or cool the hot gas product. In one or more embodiments, at least a portion of the first waste water in line 110 and/or the second waste water in line 130 can be introduced to the oxidation zone, the reduction zone, and/or the gasification zone to directly cool or quench the hot gas.

In one or more embodiments, the first waste water in line 115 and/or the second waste water in line 130 can be treated or untreated. In one or more embodiments, untreated waste water, e.g. the first waste water, the second waste water, or a mixture thereof can be indirectly or directly heated in the one or more heat exchangers 170 using the hot gas product to provide suitable high pressure steam for use in a SAGD process or other steam thermal work. In one or more embodiments, the first waste water in line 110, 115 and/or the second waste water in line 130 can be treated to remove contaminants such as hydrocarbons and/or metals prior to disposal and/or prior to introducing the waste water to the one or more heat exchangers 170.

In one or more embodiments, the one or more heat exchangers 170 can provide low pressure steam, medium pressure steam, high pressure steam, superheated steam, or high pressure superheated steam via line 174. The steam in line 174 can be used in a SAGD process, other steam thermal work, and/or to power one or more steam turbines (not shown) to drive a directly coupled electric generator (not shown).

In one or more embodiments, the steam in line 174 can have a temperature of about 200° C. or more, 300° C. or more, 400° C. or more, 450° C. or more, 475° C. or more, or 500° C. or more. In one or more embodiments, the pressure of the steam in line 174 can range from about 200 kPa to about 8,350 kPa, about 300 kPa to about 6,290 kPa, or about 600 kPa to about 4,225 kPa.

In one or more embodiments, the cooled gas product in line 175 can be cooled to a temperature of from about 150° C. to about 850° C., from about 260° C. to about 705° C., or from about 260° C. to about 425° C. In one or more embodiments, the cooled gas product in line 175 can be cooled to a temperature of about 500° C. or less, about 400° C. or less, about 300° C. or less, about 200° C. or less, or about 150° C. or less.

The one or more heat exchangers 170 can include any system, device or combination of systems and/or devices suitable for generating steam from the first waste water in line 110 and/or the second waste water in line 130, or any other source of water. The one or more heat exchangers 170 can include, but are not limited to, one or more U-tube heat exchangers, shell-and-tube heat exchangers, plate-and-frame heat exchangers, or any combination thereof. The one or more heat exchangers 170 can include a water-tube or a fire-tube type waste heat boiler.

Figure 2:
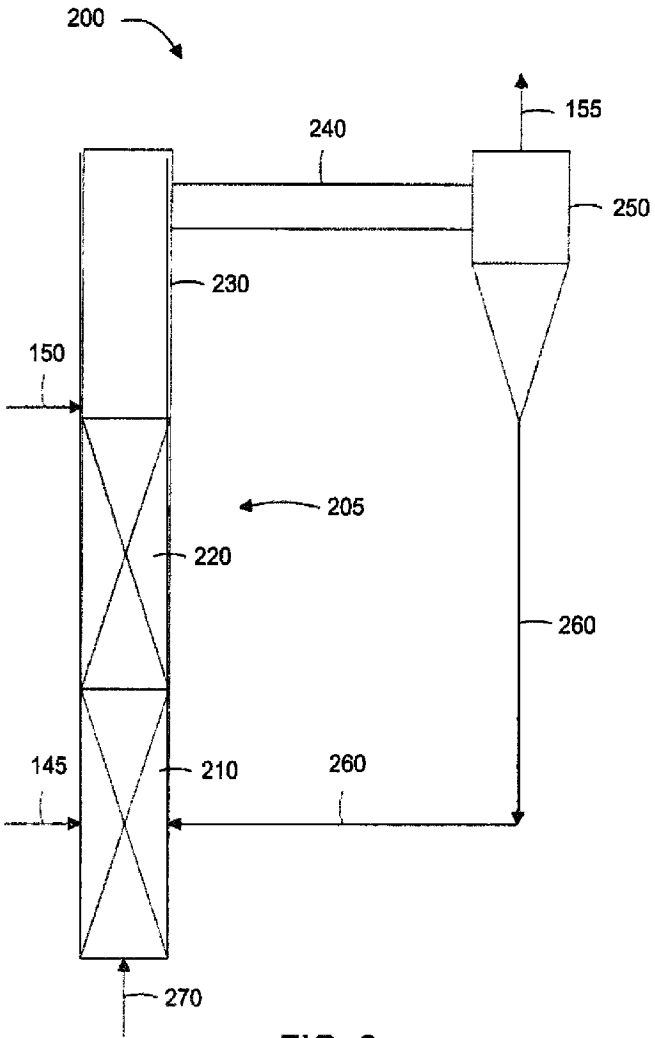
FIG. 2 depicts an illustrative gasification system for gasifying a dewatered hydrocarbon, according to one or more embodiments described.

FIG. 2 depicts an illustrative gasification system 200 for gasifying a dewatered hydrocarbon according to one or more embodiments. The gasification system 200 can include one or more gasifiers 205, ducts 240, separation systems 250, and J-legs 260. In one or more embodiments, the gasifier 205 can contain one or more zones, including an oxidation zone 210, a reduction zone 220 and a gasification zone 230. The oxidation zone 210, the reduction zone 220, and the gasification zone 230 can be arranged in any order, configuration and/or frequency. In one or more embodiments, the zones can be disposed vertically, horizontally, or at any other angle. For example, in a vertical arrangement the gasification zone 230 can be disposed above the reduction zone 220, and the reduction zone 220 can be disposed above the oxidation zone 210.

In one or more embodiments, at least a portion of the third mixture in line 145 can be introduced to the oxidation zone 210. As discussed and described above in reference to FIG. 1, the third mixture in line 145 can include from about 5% wt to about 40% wt water. In one or more embodiments, one or more oxidants via line 270 can be introduced to the oxidation zone 210. In one or more embodiments, one or more hydrocarbon containing solids via the J-leg 260 can be introduced to the oxidation zone 210. The third mixture in line 145, the one or more oxidants in line 270 and the one or more hydrocarbon containing solids in the J-leg 260 can be introduced simultaneously, sequentially, alternatively, or any combination thereof, to the oxidation zone 210 based upon operating conditions within the oxidation zone 210 and the desired finished products.

In one or more embodiments, the third mixture introduced via line 145, and other carbonaceous material, such as the coke on the hydrocarbon containing solids introduced via the J-leg 260, can be partially or completely combusted or otherwise oxidized in the oxidation zone 210. In one or more embodiments, the oxidant can include air, oxygen, oxygen-enriched air, oxygen containing compounds, mixtures thereof, derivatives thereof or any combination thereof. In one or more embodiments, the molar oxygen concentration within the oxidation zone 210 can be sub-stoichiometric based upon the molar concentration of carbon introduced to the oxidation zone 210. In one or more embodiments, the oxygen concentration within the oxidation zone 210 can range from about 5% to about 90% of stoichiometric requirements, about 5% to about 75% of stoichiometric requirements, about 5% to about 60% of stoichiometric requirements, or about 5% to about 45% of stoichiometric requirements based on the molar concentration of carbon in the oxidation zone 210.

As used herein, the term "oxygen-enriched air" can include any gas stream containing air and having an oxygen concentration greater than 21% vol oxygen. The term "air" can include any gaseous mixture having a nitrogen concentration of about 79% vol and an oxygen concentration of about 21% vol.

The oxidation of the third mixture and other carbonaceous materials can provide a high-temperature combustion gas or the hot gas, which can be as discussed and described above in reference to FIG. 1. The high-temperature combustion gas or hot gas can include, but is not limited to, hydrogen, carbon monoxide, carbon dioxide, and water vapor. Within the oxidation zone 210, the relative concentrations of carbon monoxide and carbon dioxide can be controlled by adjusting the oxygen concentration in the oxidant supplied via line 270 to the oxidation zone 210. In one or more embodiments, the temperature of the hot gas exiting the oxidation zone 210 can be about 955° C. or more, about 1,090° C. or more, about 1,230° C. or more, about 1,370° C. or more, or about 1,510° C. or more.

In one or more embodiments, the hot gas exiting the oxidation zone 210 can pass into the reduction zone 220 where additional reactions can occur. In one or more embodiments, the additional reactions can include, but are not limited to water/gas shift reactions. In one or more embodiments, the reactions within the reduction zone 220 can be endothermic, thereby reducing the temperature of the hot gas exiting the reduction zone 220. In one or more embodiments, the temperature of the hot gas exiting the reduction zone 220 can be about 400° C. or more, about 500° C. or more, about 600° C. or more, about 700° C. or more, about 850° C. or more, about 930° C. or more, about 1,010° C. or more, or about 1,090° C. or more.

The hot gas exiting the reduction zone 220 can pass into the gasification zone 230 where all or a portion of the second portion in line 150 can be introduced. The second portion in line 150 can be introduced at one or more points located within the oxidation zone 210, reduction zone 220, gasification zone 230, ducts 240, or any combination thereof. In one or more embodiments, all or a portion of the second portion in line 150 can be introduced to the gasifier 200 proximate the exit of the reduction zone 220 and/or entrance to the gasification zone 230. In one or more embodiments, all or a portion of the second portion in line 150 can be introduced to the gasifier 200 at a point where the temperature of the gasifier is greater than about 400° C., greater than about 500° C., grater than about 600° C., 680° C., greater than about 760° C., greater than about 845° C., or greater than about 930° C.

Upon introduction of the second portion in line 150 to the gasifier 200, any light hydrocarbons present in the second portion, such as naphthas, distillates, and gas oils, can vaporize, while other hydrocarbons present in the second portion, such as bitumens, can vaporize and/or thermally crack to provide one or more cracked hydrocarbon compounds. At least a portion of the uncracked or residual hydrocarbons in the gasification zone 230 can deposit as a layer of carbonaceous coke on the surface of the solids present in the high-temperature combustion gas within the gasification zone 230. Within the gasification zone 230, the hot gas mixture exiting the oxidation zone 210 can combine, mix, and/or react with the vaporized hydrocarbons and the cracked hydrocarbons to provide a gasified mixture or hot gas product via the duct 240. In one or more embodiments, at least a portion of the second portion via line 150 can be introduced to the duct 240 to provide vaporized and/or cracked hydrocarbons.

In one or more embodiments, the second portion introduced via line 150 to the gasification zone 230 can be heated to temperatures of about 750° C. or more, about 1,000° C. or more, about 1,250° C. or more, about 1,400° C. or more, or about 1,650° C. or more. In one or more embodiments, the temperature of the gasification zone 230 can range from a low of about 400° C., In one or more embodiments, the residence time of the second portion introduced via line 150 to the gasification zone 230 can range from about 1 millisecond ("ms") to about 15 seconds ("s"). In one or more embodiments, the residence time of the second portion introduced via line 150 to the gasification zone 230 can range from a low of about 50 ms, about 100 ms, about 150 ms, or about 200 ms to a high of about 1 s, about 3 s, about 5 s, or about 8 s. The residence time of the second portion introduced via line 150 to the gasification zone 230 can be controlled or otherwise adjusted by introducing the hydrocarbon further downstream from the reduction zone 220 and/or the oxidation zone 210. For example, introducing the hydrocarbon just downstream the oxidation zone 110 into the reduction zone 220 or just down stream the reduction zone 220 to the gasification zone 230 would provide a longer residence time than introducing the second portion to the transition line 240.

The gasified mixture or hot gas in the duct 240 can include, but is not limited to hydrogen, carbon monoxide, carbon dioxide, water, hydrogen, one or more hydrocarbons, and coke-covered solids. The gasified mixture or hot gas in the duct 240 can be introduced to one or more particulate separation systems 250 to provide a hot gas product in line 155 and a hydrocarbon containing solids recycle via line 260. In one or more embodiments, the hot gas product in line 155 and the hydrocarbon containing solids in line or J-leg 260 can be as discussed and described above in reference to FIG. 1.

The hydrocarbon containing solids concentration in the hot gas product in line 155 can be less than about 1,000 ppmw, about 500 ppmw, about 400 ppmw, about 250 ppmw, about 100 ppmw, about 50 ppmw, about 10 ppmw, about 1 ppmw, or about 0.1 ppmw. The solids concentration in the line 260 can range from about 5% wt to about 90% wt, about 10% wt to about 80% wt, about 20% wt, to about 70% wt, or about 30% wt to about 60% wt.

In one or more embodiments, the one or more particulate separation systems 250 can include any system, device, or combination of systems and/or devices capable of providing an outlet particulate concentration less than about 1,000 ppmw, about 500 ppmw, about 400 ppmw, about 250 ppmw, about 100 ppmw, about 50 ppmw, about 10 ppmw, about 1 ppmw, or about 0.1 ppmw. In one or more embodiments, the particulate separation systems 250 can include one or more cyclonic and/or gravity separators arranged in series or in parallel. In one or more embodiments, the one or more particulate separation systems 250 can include one or more high throughput, low efficiency and/or high efficiency cyclonic separators. In one or more embodiments, the particulate separation system 250 can include one or more particulate control devices ("PCDs"). Illustrative PCDs can include, but are not limited to, electrostatic precipitators, sintered metal filters, metal filter candles, and/or ceramic filter candles (for example, iron aluminide filter material).

Although not shown, in one or more embodiments, the first waste water and/or the second waste water, see FIG. 1, in lines 110 and 130 can be introduced to the combustion zone 210, the reduction zone 220, the gasification zone 230, and/or the duct 240 to directly cool or quench the hot gas.

Figure 3:
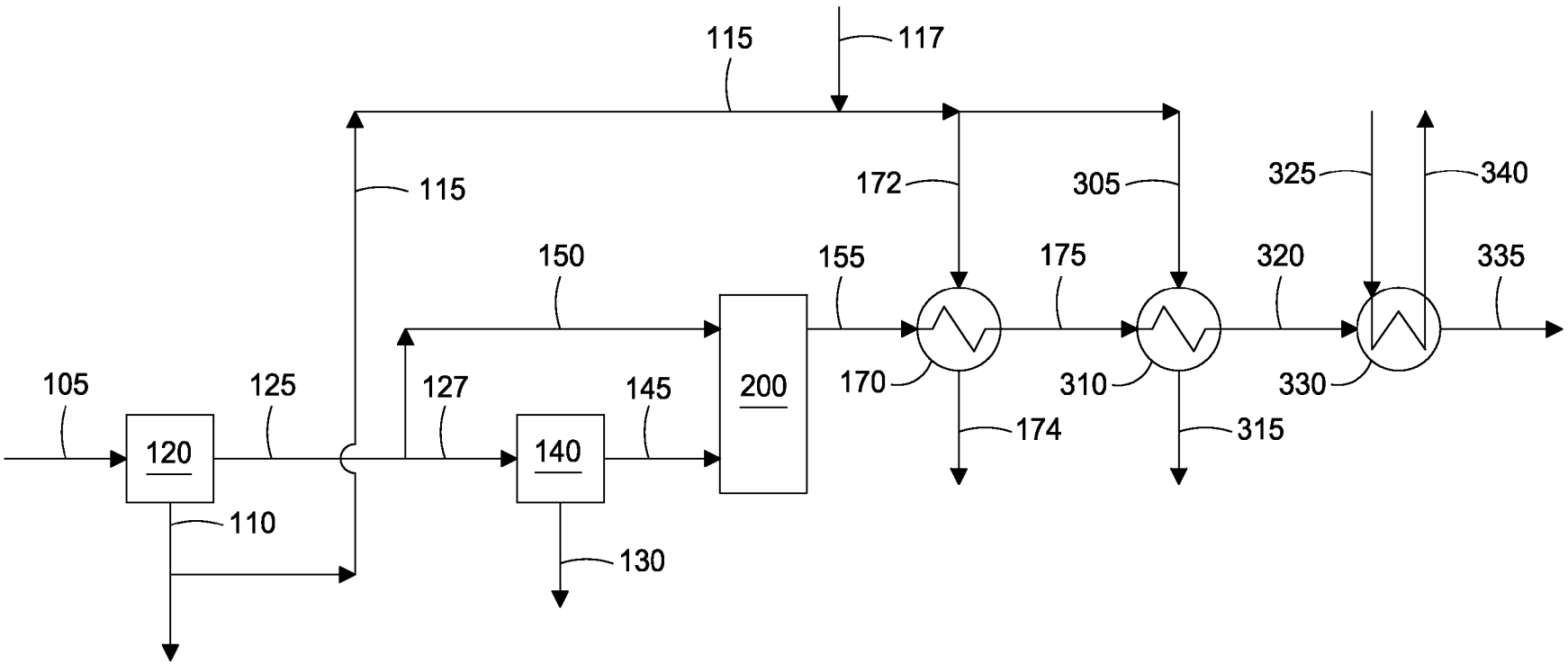
FIG. 3 depicts another illustrative treatment system for processing a hydrocarbon and water mixture, according to one or more embodiments described.

FIG. 3 depicts another illustrative treatment system for processing a hydrocarbon and water mixture, according to one or more embodiments. In one or more embodiments, the one or more separators 120, 140, one or more gasifiers 200, and one or more heat exchangers 170 can be as discussed and described above in reference to FIGS. 1 and 2. In one or more embodiments, the treatment system can further include one or more additional heat exchangers (two are shown 310, and 330). In one or more embodiments, the first waste water via line 115, second waste water via line 130, supplemental or make-up water via line 117, or combinations thereof can be indirectly heated within the heat exchangers 170, 330, and 300 using the hot gas product to provide steam and a cooled gas product.

In one or more embodiments, the hot gas product via line 155 and the first waste water via line 115 with or without supplemental water via line 117 can be introduced to the heat exchanger or first heat exchanger 170 via line 172 to provide high pressure steam via line 174 and a first cooled gas product via line 175. In one or more embodiments, the first cooled gas product via line 175 and the first waste water via line 115 with or without supplemental water via line 117 can be introduced to the heat exchanger or second heat exchanger 310 via line 305 to provide a second cooled gas product via line 320 and medium pressure steam via line 315. In one or more embodiments, the second cooled gas product via line 320 and water via line 325 can be introduced to the heat exchanger, or third heat exchanger 330 to provide a third or final cooled gas product via line 335 and low pressure steam via line 340. In one or more embodiments, the water introduced via line 325 to the third heat exchanger 330 can include the first waste water, the second waste water, supplemental waste water, or other process water.

Although not shown, the first waste water via line 115, the second waste water via line 130, supplemental water via line 117 or mixtures thereof can be introduced to the first heat exchanger 170, second heat exchanger 330, and/or the third heat exchanger 330 to provide steam via lines 174, 315, and 340, respectively. In one or more embodiments, equal or unequal amounts of the first waste water via line 115, second waste water via line 130, and/or supplemental/make-up water via line 117 can be introduced to the heat exchangers 170, 315, and/or 330. The first waste water in line 115 and/or the second waste water in line 130 can be treated to remove contaminants or untreated, i.e. include contaminants.

In one or more embodiments, the temperature of the first cooled gas product in line 175 can range from a low of about 300° C., about 400° C. or about 500° C. to a high of about 900° C., about 1,200° C., or about 1,350° C. In one or more embodiments, the temperature of the second cooled gas product in line 320 can range from a low of about 230° C., about 300° C., or about 400° C. to a high of about 700° C., about 900° C., or about 1,050° C. In one or more embodiments, the temperature of the third or final cooled gas product in line 335 can range from a low of about 100° C., about 150° C., or about 200° C. to a high of about 300° C., about 400° C., or about 500° C.

In one or more embodiments, at least a portion of the steam in lines 174, 315, and 340 can be used to stimulate the extraction of additional hydrocarbons via SAGD or other steam thermal work. In one or more embodiments, at least a portion of the steam in lines 174, 315, and 340 can be supplied to other process equipment including one or more steam turbines, one or more absorption chillers, process heaters, or any combination thereof. In one or more embodiments, the one or more steam turbines can be used to provide mechanical and/or electrical power. In one or more embodiments, at least a portion of the steam in lines 174, 315, and 340 can be supplied to a commercial and/or industrial distribution system. In one or more embodiments, the steam in lines 174, 315, 340 can be saturated or superheated.

Certain embodiments and features have been described using a set of numerical upper limits and a set of numerical lower limits. Ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for processing hydrocarbons, comprising:

selectively separating water from a first mixture comprising one or more hydrocarbons and water to provide a first waste water and a second mixture comprising the one or more hydrocarbons and water, wherein the water concentration of the second mixture ranges from about 2.5% wt to about 75% wt;

apportioning the second mixture into a first portion and a second portion;

selectively separating the first portion to provide a second waste water and a third mixture comprising the one or more hydrocarbons and water, wherein the water concentration of the third mixture ranges from about 1% wt to about 40% wt;

combusting at least a portion of the third mixture and hydrocarbon containing solids in the presence of an oxidant to provide a combustion gas, wherein the combustion gas comprises carbon monoxide, carbon dioxide, and water, wherein the combustion gas is at a temperature of from about 400° C. to about 1,650° C.;

gasifying a portion of the hydrocarbon containing solids to provide regenerated solids and gasified hydrocarbons comprising hydrogen, carbon monoxide, and carbon dioxide;

vaporizing a portion of the second portion in the presence of the combustion gas and gasified hydrocarbons to provide vaporized hydrocarbons;

cracking a portion of the second portion in the presence of the combustion gas and gasified hydrocarbons at a temperature sufficient to provide cracked hydrocarbons comprising more than 0.5% vol $C_1$-$C_3$ hydrocarbons, more than 0.5% vol $C_1$-$C_6$ hydrocarbons, and more than 1% vol $C_7$-$C_9$ hydrocarbons;

depositing liquid hydrocarbons, solid hydrocarbons, or both onto the regenerated solids to provide the hydrocarbon containing solids; and selectively separating at least a portion of the combustion gas, gasified hydrocarbons, vaporized hydrocarbons, and cracked hydrocarbons from the hydrocarbon containing solids to provide a hot gas product.

2. The method of claim 1, further comprising indirectly transferring heat from the hot gas product to at least a portion of the first waste water, the second waste water, or a mixture thereof to provide steam and a cooled gas product.

3. The method of claim 2, wherein the steam is used in a steam assisted gravity drainage process or other steam thermal work.

4. The method of claim 2, further comprising selectively separating the cooled gas product to provide at least two of ethane, ethylene, propane, propylene, butane, butene, pentane, pentene, hexane, hexene, heptane, and heptene.

5. The method of claim 1, further comprising:

treating the first waste water, the second waste water, or both to provide a treated waste water, and directly or indirectly transferring heat from the hot gas product to the treated waste water to provide steam and a cooled gas product.

6. The method of claim 5, wherein the steam is used in a steam assisted gravity drainage process or other steam thermal work.

7. The method of claim 1, wherein the first mixture comprises one or more crude oils, oil shales, oil sands, tars, bitumens, derivatives thereof, and mixtures thereof.

8. The method of claim 1, wherein the water concentration of the first mixture ranges from about 30% wt to about 90% wt.

9. The method of claim 1, wherein the amount of oxidant present is from about 1% to about 50% of the stoichiometric oxygen required to oxidize the total amount of hydrocarbons in the third mixture and the hydrocarbon containing solids.

10. The method of claim 1, wherein the first mixture comprises one or more hydrocarbons extracted using steam assisted gravity drainage.

11. A method for processing hydrocarbons, comprising:

selectively separating water from a first mixture comprising one or more hydrocarbons and water in a first separation zone to provide a first waste water and a second mixture comprising the one or more hydrocarbons and water, wherein the water concentration of the second mixture ranges from about 30% wt to about 75% wt;

apportioning the second mixture into a first portion and a second portion;

selectively separating the first portion in a second separation zone to provide a second waste water and a third mixture comprising the one or more hydrocarbons and water, wherein the water concentration of the third mixture ranges from about 5% wt to about 40% wt;

combusting at least a portion of the third mixture and hydrocarbon containing solids in the presence of an oxidant in a combustion zone to provide a combustion gas, wherein the combustion gas comprises carbon monoxide, carbon dioxide, and water, wherein the amount of oxidant present is from about 1% to about 50% of the stoichiometric oxygen required to oxidize the total amount of hydrocarbons in the third mixture and the hydrocarbon containing solids, and wherein the combustion gas is at a temperature of from about 400° C. to about 1,650° C.;

gasifying a portion of the hydrocarbon containing solids to provide regenerated solids and gasified hydrocarbons comprising hydrogen, carbon monoxide, and carbon dioxide;

vaporizing a portion of the second portion in the presence of the combustion gas and gasified hydrocarbons in a vaporization zone to provide vaporized hydrocarbons;

cracking a portion of the second portion in the presence of the combustion gas and gasified hydrocarbons in a cracking zone at a temperature sufficient to provide cracked hydrocarbons comprising more than 5% vol $C_1$-$C_3$ hydrocarbons, more than 5% vol $C_4$-$C_6$ hydrocarbons, and more than 1% vol $C_7$-$C_9$ hydrocarbons;

depositing liquid hydrocarbons, solid hydrocarbons, or both onto the regenerated solids in a deposition zone to provide the hydrocarbon containing solids; and selectively separating at least a portion of the combustion gas, gasified hydrocarbons, vaporized hydrocarbons, and cracked hydrocarbons from the hydrocarbon containing solids to provide a hot gas product.

12. The method of claim 11 further comprising indirectly transferring heat from at least a portion of the hot gas product to at least a portion of the first waste water, the second waste water, or a mixture thereof to provide steam.

13. The method of claim 12, further comprising treating the first waste water, the second waste water, or the mixture thereof prior to indirectly transferring heat from at least a portion of the hot gas product.

14. The method of claim 12, wherein at least a portion of the steam is used in a steam assisted gravity drainage process or other steam thermal work.

15. The method of claim 12, wherein at least a portion of the waste water is used to cool the hot gas product by direct contact, indirect heat exchange, or both.

16. The method of claim 11 further comprising indirectly transferring heat from at least a portion of the hot gas product to at least a portion of the first waste water, second waste water, or a mixture thereof to provide at least one of a high pressure steam, a medium pressure steam, and a low pressure steam.

17. The method of claim 11, wherein the first mixture comprises one or more crude oils, oil shales, oil sands, tars, bitumens, derivatives thereof, or mixtures thereof.

18. The method of claim 11, wherein the second portion is vaporized and cracked at temperature of 400° C. or more.

19. The method of claim 11, wherein the first mixture comprises one or more hydrocarbons extracted using steam assisted gravity drainage.

20. A method for processing hydrocarbons, comprising:

selectively separating water from a first mixture comprising bitumens and water in a first separation zone to provide a first waste water and a second mixture comprising the bitumens and water, wherein the water concentration of the first mixture is at least 50% wt, and wherein the water concentration of the second mixture ranges from about 20% wt to about 50% wt;

apportioning the second mixture into a first portion and a second portion;

selectively separating the first portion in a second separation zone to provide a second waste water and a third mixture comprising the bitumens and water, wherein the water concentration of the third mixture ranges from about 5% wt to about 40% wt;

combusting at least a portion of the third mixture and hydrocarbon containing solids in the presence of an oxidant in a combustion zone to provide a combustion gas, wherein the combustion gas comprises carbon monoxide, carbon dioxide, and water, wherein the amount of oxidant present is from about 1% to about 50% of the stoichiometric oxygen required to oxidize the total amount of hydrocarbons in the third mixture and the hydrocarbon containing solids, and wherein the combustion gas is at a temperature of from about 400° C. to about 1,650° C.;

gasifying a portion of the hydrocarbon containing solids to provide regenerated solids and gasified hydrocarbons comprising hydrogen, carbon monoxide, and carbon dioxide;

vaporizing a portion of the second portion in the presence of the combustion gas and gasified hydrocarbons in a vaporization zone to provide vaporized hydrocarbons;

cracking a portion of the second portion in the presence of the combustion gas and gasified hydrocarbons in a cracking zone at a temperature sufficient to provide cracked hydrocarbons comprising more than 5% vol $C_1$-$C_3$ hydrocarbons, more than 5% vol $C_4$-$C_6$ hydrocarbons, and more than 1% vol $C_7$-$C_9$ hydrocarbons;

depositing liquid hydrocarbons, solid hydrocarbons, or both onto the regenerated solids in a deposition zone to provide the hydrocarbon containing solids;

selectively separating at least a portion of the combustion gas, gasified hydrocarbons, vaporized hydrocarbons, and cracked hydrocarbons from the hydrocarbon containing solids to provide a hot gas product;

indirectly exchanging heat from the hot gas product to the first waste water, the second waste water, or both to provide a cooled gas product and high pressure steam;

using the high pressure steam in a steam assisted gravity drainage process, and recovering a hydrocarbon mixture from the steam assisted gravity drainage process, wherein the hydrocarbon mixture comprises hydrocarbons and water, and wherein the first mixture comprises at least a portion of the hydrocarbon mixture.

21. The method of claim 1, wherein a temperature of the first mixture ranges from about 1° C. to about 125° C. when water is selectively separated therefrom.

22. The method of claim 11, wherein a temperature of the first mixture ranges from about 1° C. to about 125° C. when water is selectively separated therefrom.

23. The method of claim 20, wherein a temperature of the first mixture ranges from about 1° C. to about 125° C. when water is selectively separated therefrom.

* * * * *